US006733420B1

(12) United States Patent
Schroeder

(10) Patent No.: US 6,733,420 B1
(45) Date of Patent: May 11, 2004

(54) EXERCISE APPARATUS

(76) Inventor: Herbert E. Schroeder, 143 N. Commonwealth Ave., Los Angeles, CA (US) 90004

( * ) Notice: Subject to any disclaimer, the term of this patent is extended or adjusted under 35 U.S.C. 154(b) by 0 days.

(21) Appl. No.: 09/880,463

(22) Filed: Jun. 12, 2001

(51) Int. Cl.[7] ..... A63B 5/11
(52) U.S. Cl. ..... 482/27; 482/29
(58) Field of Search ..... 482/27, 28, 29

(56) References Cited

U.S. PATENT DOCUMENTS 3,677,368 A * 7/1972 Green ..... 182/139
3,892,403 A * 7/1975 Green ..... 182/139
4,386,772 A * 6/1983 Wu ..... 272/65
4,452,444 A * 6/1984 Schulze, Jr. ..... 272/65
5,336,135 A * 8/1994 Keyvani ..... 472/137

* cited by examiner

*Primary Examiner*—Nicholas D. Lucchesi
*Assistant Examiner*—Tam Nguyen
(74) *Attorney, Agent, or Firm*—Frank L. Zugelter

(57) ABSTRACT

A rectangularly-shaped exercise apparatus (20) having an endless frame (22) formed by angular elements (24) joined together at their adjacent corners (25) that include shoulders (45) and gussets (46). A bed (29) of fabric is disposed within frame (20) and joined to it by coiled springs (31) attaching the bed's grommets (33) to pins (38) extending from horizontally-oriented flanges (26) of angular elements (24), being held to pins (38) by washer-nuts 41/42). A socket (29) is securely mounted at the corners (25) to the undersides (39) of flanges (26) and into which deep-stroked leg assemblies (52) having springs (56) are slip fit. The leg assemblies (52) include an additional stroke displacement over the spring's stroke displacement by a plunger (53) over which the spring's tubular cylinder (54) displaces.

10 Claims, 5 Drawing Sheets

27
26
41
42
31
50
48
49
46
8
45
47
29
32
33
35
38
36
44
39
40

EXERCISE APPARATUS

TECHNICAL FIELD

This invention is directed to an exercise apparatus containing a full suspension system of a bed, a flexing frame and deep-stroked shock-absorbing legs.

BACKGROUND TO THE INVENTION

The device of this invention advances the art of exercise apparata by a unique construction in its system of a full suspension construction of elements including a distinct flexing frame, a bed as a compliant component of the device, and deep-stroke supporting legs, all of which not heretofore found in exercise apparata or trampolines of a personal compact size. Playful and fun-jumping trampolines in the past have been used as exercising devices, however, are limited in terms of use as an exercise device.

In prior art exercising equipment of a nature including a bed on which an exerciser (human being) would maneuver in a bouncing technique on it, sagging of the bed would occur as a result of loss of tension between bed and frame. Rebounding magnitude and movement would be retarded, and/or relaxing of muscles throughout the user's body would occur. However, in this invention, the exercise bed or platform provides for a non-traumatic movement of body tissues as part of a non-exertion exercise device or system. With the full suspension system of this apparatus, rebounding and bouncing movements forces all of the body muscles to flex simultaneously and uniformly, and with regular use of the apparatus an improved healthier body and mental condition occurs. This exercise apparatus is a step forward for returning or recycling energy into human beings who desire to become healthier in mind and body.

Disclosures of prior art trampoline construction are found in U.S. Pat. Nos. 3,561,564; 3,677,368; and 3,892,403.

SUMMARY OF THE INVENTION

The exercise apparatus of this invention comprises generally a rectangular flexible (non-rigid) frame formed of lightweight steel construction with elasticity in the construction of the apparatus to make it flexible, a bed formed of fabric resiliently supported in a tightly stretched condition within the frame by a series of coiled springs connecting the bed interiorly of and to the frame. Hook ends on corresponding series of coiled springs are attached to the bed by means of grommets about holes along the margins of the fabric, however, the hooks on the other ends of the coiled springs attach to studs or pins strongly secured to horizontally-inclined flanges of angular elements forming the frame while nuts or other suitable elements prevent the loss of the attachment of the hook ends of the coiled springs from their corresponding pins or studs after such attachment. Deep-stroking leg assemblies provide for a full suspension in their locations at the corners of adjacent angular elements forming the frame. In the exercising action on the apparatus by an exerciser (human being) at any point of the bed, one or more of the frame's angular elements displace in degree and kind, i:e., twist and bend, and by which flexing of the frame occurs, vis-a-vis non-flexing in a rigid frame, due to different displacements of the strokes in the various leg assemblies, in a manner distinct from the movements of rigid frame members of prior art teachings. A healthier condition for the exerciser coincides with the full suspension system and flexing of the frame than was produced or achieved in or with heretofore known exercising apparata.

An object of this invention is to provide a full suspension system in the construction of an exercising apparatus.

Another object of this invention is to provide in the exerciser as a result of exercising on the apparatus stimulation of the brain and body cells, oxygenation of blood and tissues, reduction of stress, development of muscle control, a positive increase of coordination, rhythm, and balance, and a build-up of strength and endurance, all of which promote good health.

Another important object of the invention is to eliminate trauma and shock associated with older types of exercising equipment.

A further object of this invention is to provide for complete compliance of the bed in relation to the deep-stroke leg assemblies of the apparatus so that bottoming out of the bed in exercising on it is eliminated.

These and other object and advantages will become apparent upon a full and complete reading of the following description, its appended claims, and the accompanying drawing comprising five (5) sheets of eight (8) FIGURES.

BEST MODE FOR CARRYING OUT THE INVENTION

Figure 1:
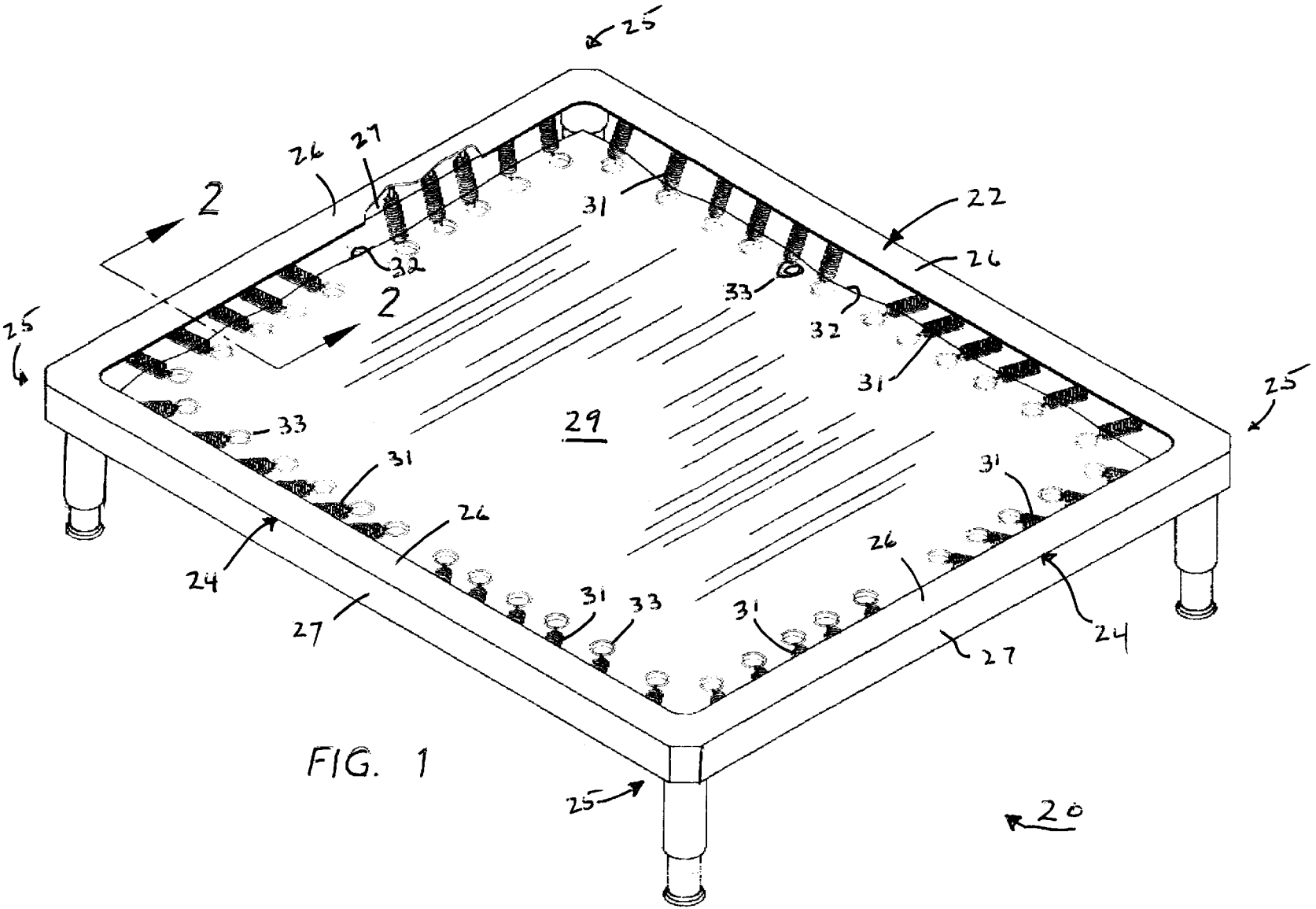
FIG. 1 is a perspective view of the exercise apparatus of this invention.

Referring now to the drawing in which reference characters refer to like numerals hereinafter, FIG. 1 illustrates an apparatus 20 of this invention. Apparatus 20 comprises an endless frame 22, rectangularly shaped, and formed by angular elements 24 connected at their lineal ends to form corners 25 with their adjacent angular elements. Each angular element 24 includes an elongated horizontally-inclined flange 26, integrally formed, in the fabrication of frame 22, with a vertically-inclined flange 27. A bed 29 of resilient material or fabric, for example, of a plastic woven mesh, is disposed within a spacing generated within the angular elements 24 and which spacing is sufficient for the insertion of a series of coiled springs 31, preferably of the same length and size, between all of the edges 32 of bed 29 and which connect it to the frame's angular elements 24. Bed 29 includes a series of spaced grommets 33 in its margins adjacent its edges 32 and to which a corresponding hook end 35 of a coiled spring 31 attaches to a corresponding one of the grommets 33. The other hook end 36 of each coiled spring 31 is attached to a corresponding one of a series of studs or pins 38 spacedly secured to the horizontally-inclined flange 26 through its underside 39, FIG. 2, extending away from, preferably perpendicularly away from, the plane of underside 39 and spaced from an interior wall 40 of each vertically-oriented flange 27. A nut 41 with washer 42 integrally fabricated therewith, or other suitable element, is threaded or otherwise secured to the open end 44, FIG. 2, of each stud or pin 38 so that the attachment of hook end 36 of its corresponding coiled spring 31 is prevented from being shaken off or otherwise separated from its corresponding pin or stud 38 after assembly, or during operation of the invention, or in the handling otherwise associated with the exercise apparatus 20. It is to be noted that a safety quality to the exerciser or others is met by the attachment of coiled springs 31 to the underside of flange 26 rather than their hooks 36 being exposed exteriorly of apparatus 20 and by which one could be injured by striking or being struck by one or more of them.

Figure 8:
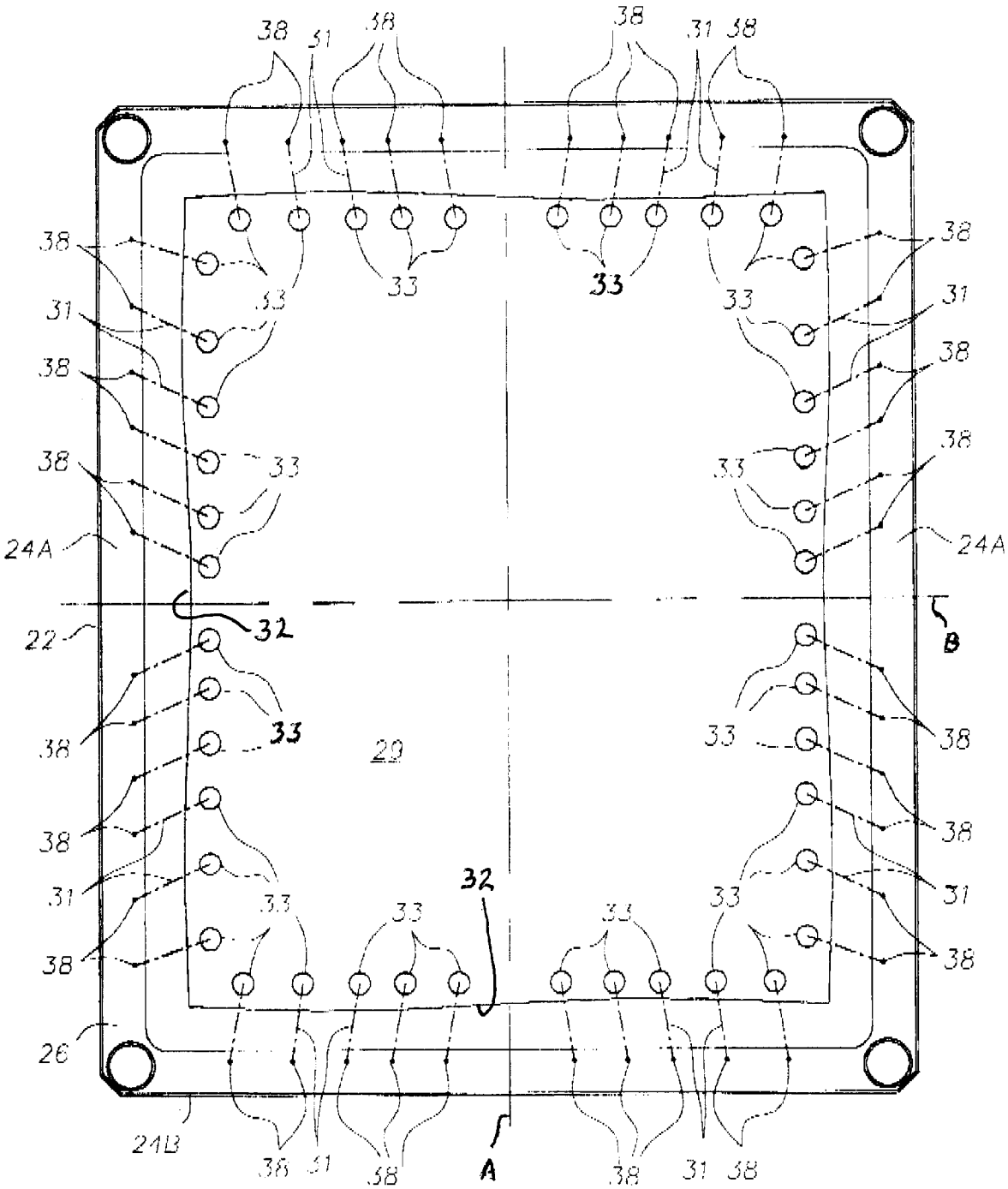
FIG. 8 is a diagrammatical plan-view of the apparatus of FIG. 1 from its bottom, illustrating the non-uniformity of spacing between grommets in the bed and between studs secured in the frame.

A tightly stretched condition for bed 29 in frame 22 is produced by providing increased spacing of the intervals between the grommets 33 of bed 29 and of the spacing of the intervals between the studs or pins 38 secured on the horizontally-oriented flanges 26 of frame 22. Starting at the center-line A in FIG. 8, and as diagrammatically illustrated therein, the intervals between the spaced grommets 33 themselves and the intervals between the spaced studs 38 themselves, and extending to the left and right of center-line A, increase in the directions towards the opposing angular elements 24A. Starting at the center-line B in FIG. 8, and as diagrammatically illustrated therein, intervals between the spaced grommets 33 themselves and the intervals between the spaced studs 38 themselves, and extending upwardly and downwardly of center-line B, increase in the directions towards the opposing angular elements 24B. Thus, it is apparent from the diagrammatic illustration of FIG . 8, that the connections of the corresponding coiled springs 31 to their corresponding grommets 33 and studs 38 in directions shown as not being perpendicular to the edges 32 of bed 29 but rather diverging towards the corners 25 provide for the tightness for bed 29 desired in the assembly of apparatus 20.

Figures 2, 3, 9:
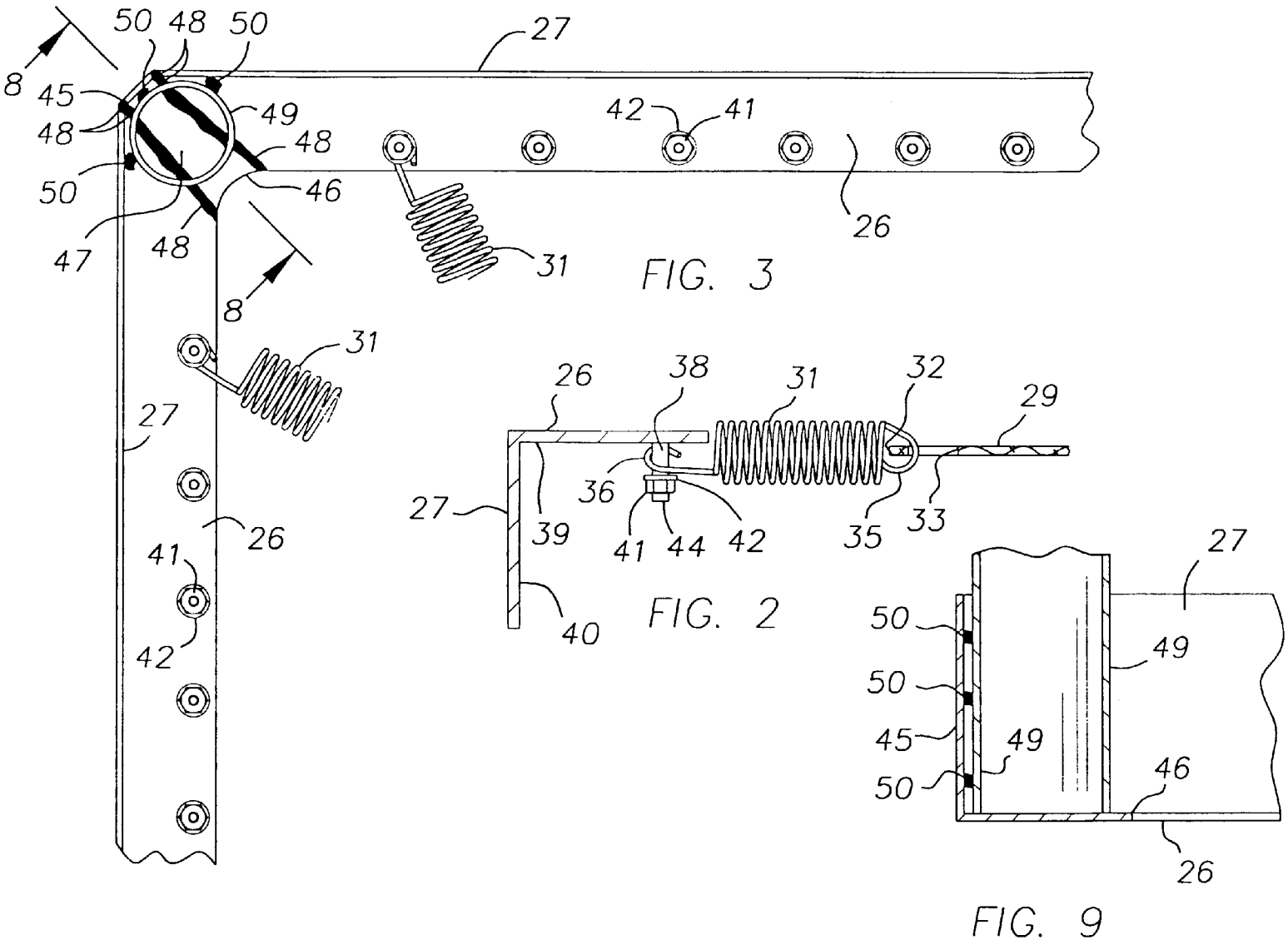
FIG. 2 is a cross-sectional view taken on line 2—2 of FIG. 1.
FIG. 3 is a fragmentary bottom view of the apparatus of FIG. 1, illustrating in part the construction of a shoulder and socket at the corner of its frame.
FIG. 9 is a view taken on line 9—9 of FIG. 3.

At each corner 25, a truncated shoulder 45 is formed and disposed in angularity with the plane of each set of adjacent vertically-oriented flanges 27 and between each set of adjacent angular elements 24. A gusset 46 in opposition to each shoulder 25 is formed and disposed in planar fashion with the plane of each set of adjacent horizontally-oriented flanges 26. Shoulder 45 and gusset 46 are fabricated from a congruous L-shaped member 47 of the same material as that for angular elements 24. Member 47 includes edges 48 that accommodate the member's welding to 45-degree cuts in each of the adjacent angular elements 24 to which member 47 is joined. A circular socket 49 is located at each corner 25, secured by welds to the noted cuts in the undersides 39 of the two adjacent horizontally-inclined flanges 26 and by point welds 50 at three (3) points as illustrated in FIG. 3, namely, two (2) point welds to the vertically-oriented walls of adjacent flanges 27 and one (1) point weld to shoulder 45. Deep-stroke leg assemblies 52, FIG. 5, slip-fit to within their corresponding sockets 49 at corners 25.

Figure 6:
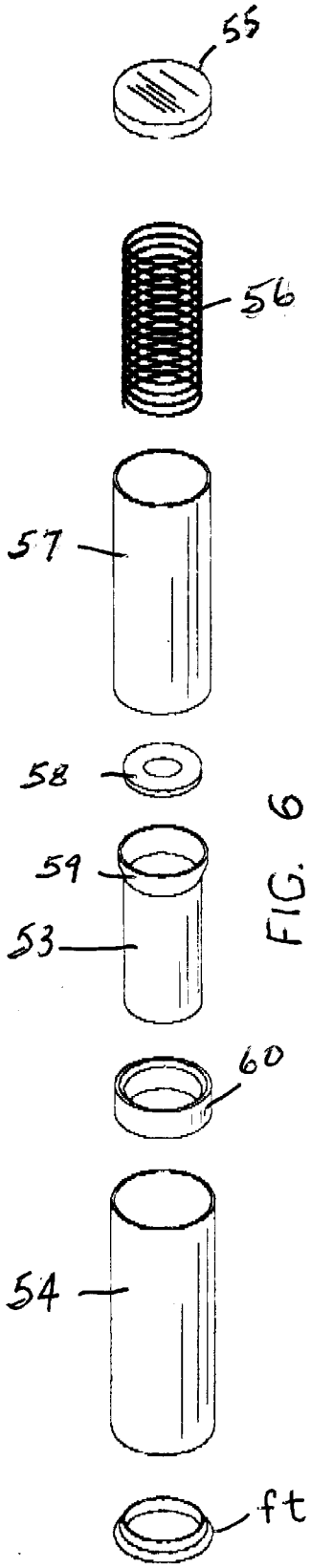
FIG. 6 is an exploded perspective view of the leg assembly of FIGS. 5 and 6, illustrated in a disassembled condition.
Figure 4:
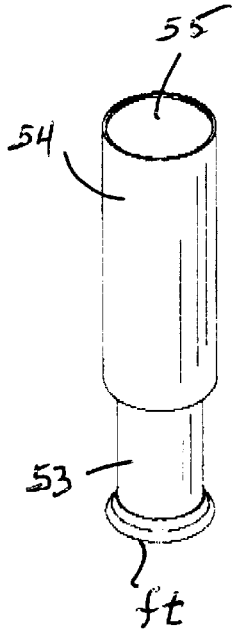
FIG. 4 is a perspective view of a deep-stroke leg assembly utilized in the apparatus of FIG. 1.
Figure 5:
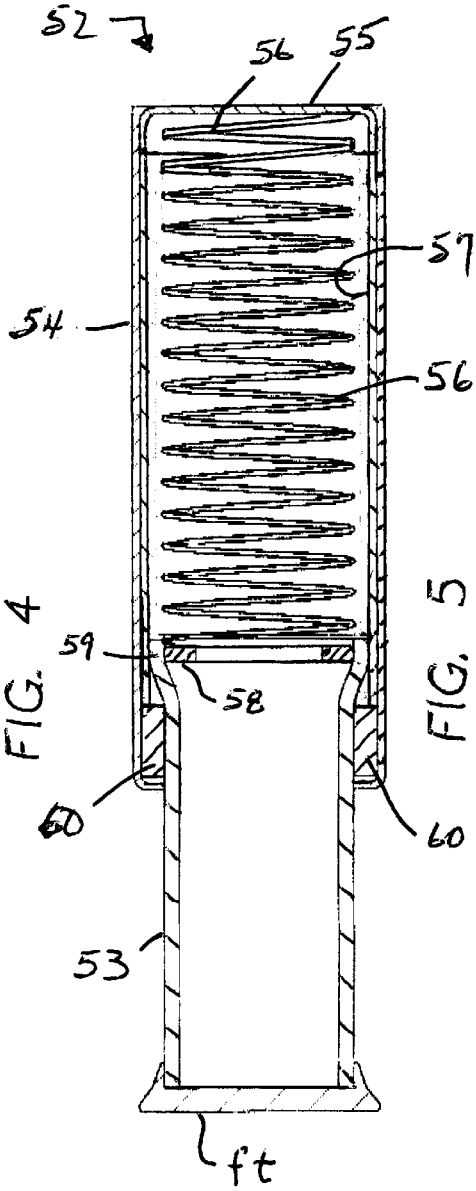
FIG. 5 is an elevational view, partially broken away, of the leg assembly of FIG. 4.

Each leg assembly 52, FIGS. 4–6, is an assembly of a plunger 53 in the form of a steel tubular member which reciprocates within a cylinder 54 whose upper end is capped by a cup 55 welded to its inner wall. A coiled spring 56 within a pre-lubricated plastic sleeve 57 extends in cylinder 54 from cup 55 to a floor 58 formed by a washer seated in a bell-shaped end portion 59 formed at the upper end of plunger 53 while a lubricating circular bearing 60 is disposed about plunger 53 between bell-shaped portion 59 and a peripheral roll 61 formed on the lower end 62 of cylinder 54. Sleeve 57 sets on bearing 60, and extends to cup 55, having the same diameter as cup 55. Coiled spring 56 tapers in its diameter as it approaches its floor 58 to avoid scoring the interior wall of cylinder 54 in reciprocating motion of leg assembly 52. Cup 55 and cylinder 54 slip fit to a corresponding socket 49 in the assembly of apparatus 20. The bottom of plunger 53 fits to a furniture foot ff that seats on a flooring fl, FIG. 8, in the operation of the invention. The complete length of each leg assembly 52, which includes a substantial length of plunger 53 that is in its reciprocating action together with the length of the stroke coiled spring 57 within its sleeve 57, effects a deep stroke for one or more of assemblies 52 during operation of the invention.

Figure 7:
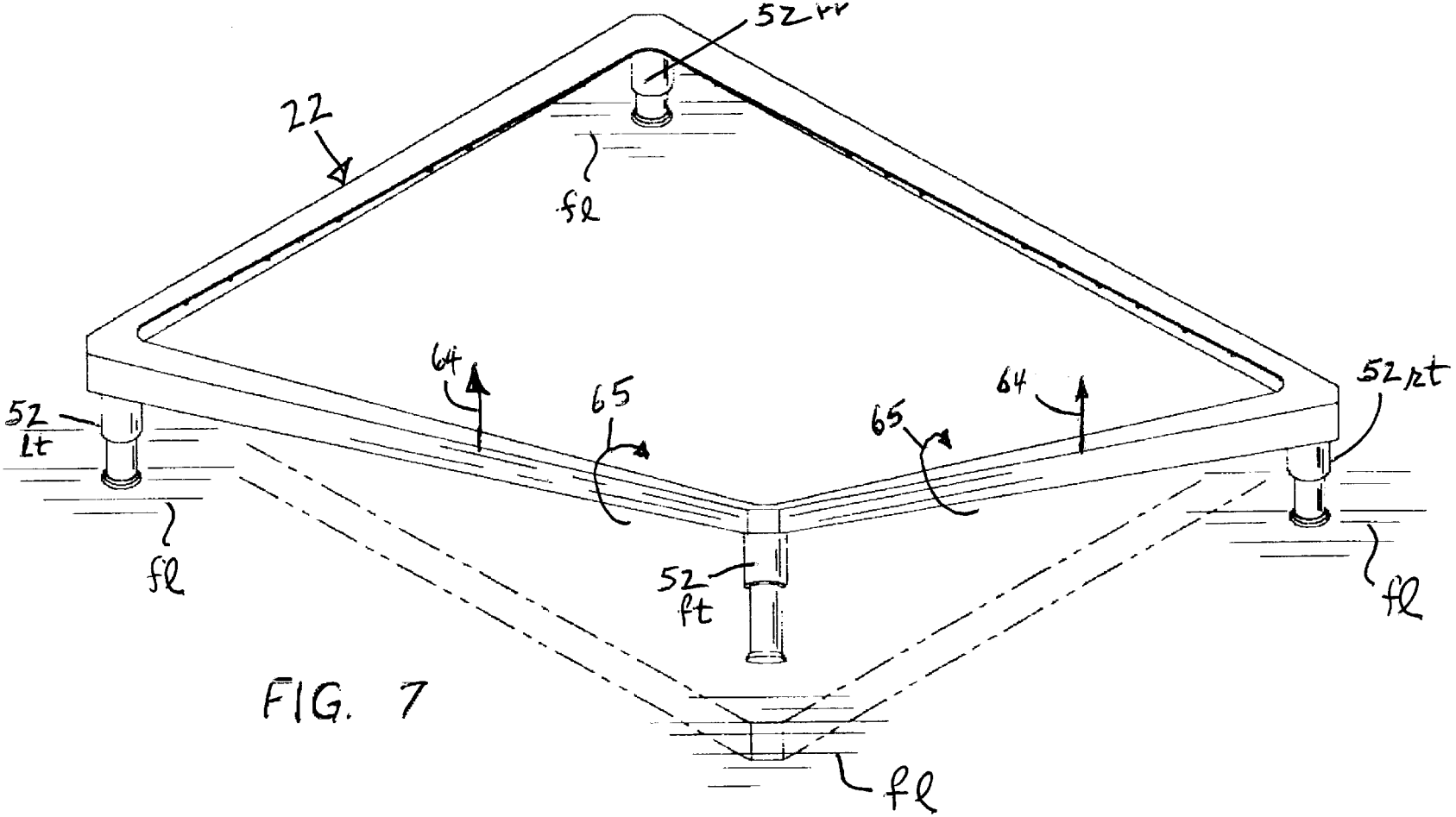
FIG. 7 is a perspective view of the frame of the apparatus in a flexed condition under use.

In operation, an exerciser/user (human being) stands atop the fabric of bed 29 and begins to bounce on it, causing the bed's fabric to be thrust downwardly at the point of the weight of the exerciser striking the fabric in each downward motion of the bouncing. FIG. 7, with the omission of bed 29 and coiled springs 31 for purposes of clarification in illustrating the flexing of the frame 22 of apparatus 20, shows the rear leg assembly 52*rr* compressed the most in the same general (downward) direction against the thrust of such a weight. The leg assemblies 52*lt* and 52*rt* are compressed to some extent as the thrust of such weight did not affect them to the same degree as it did on leg assembly 52*rr*.

It has been found in the use of apparatus 20 that the last two (2) objects of the invention enumerated above have been carried out. By this simple mechanical device and exercising method in a bouncing manner, the exerciser's health is promoted as indicated.

In assembly of apparatus 20, the fabric of bed 29 is placed within the confines of the fabricated frame 22 formed by angular elements 24, corners 25, shoulders 45, gussets 46, and studs 38.

The angular elements 24 are fabricated of cold-rolled steel having substantially a Rockwell hardness reading of zero and the materials of the other described elements are known in the manufacture of exercise apparata and may be relied on as well as other suitable materials to be fabricated for installation in apparatus 20 by known techniques in manufacture and assembly.

INDUSTRIAL APPLICABILITY

The apparatus of this invention is applicable to industries providing physical and mental improvement devices and related classes of art.

I claim:

1. In a device for exercise and for health in body and mental conditions, said device having a frame, a bed spring-mounted to said frame by a plurality of coiled springs in spaced relationship to one another to form a multi-spring suspension system for said device, the springs extending between and connecting said bed to said frame, for effecting rebounding and bouncing movements on the bed by a user of said device, and a plurality of legs each of which having one of a plurality of spring-loaded assemblies disposed therein, the improvement comprising a full non-traumatic system composed of the spring-loaded assemblies each having a deep-stroke spring, said frame including angular elements each of which having a rotational flexibility and which twists and bends in the action of the rebounding and bouncing movements on the bed by the user of said device thereby providing with the action of the deep-stroke springs in said spring-loaded assemblies a non-bottoming out of said deep-stroke springs in their spring-loaded assemblies in the action of the full suspension system, whereby action of the combination of said deep-stroke springs in said spring-loaded assemblies, multi-spring suspension system, and the twist and bend of said angular elements contributes in their actions to the fitness and to the health of the user.

2. In the improvement of claim 1, said angular elements comprise vertically-oriented flanges and horizontally-oriented flanges forming said angular elements, and an L-shaped member secured to and between each set of adjacent angular elements, said L-shaped member including a truncated shoulder secured to adjacent vertically-oriented flanges in each adjacent set of angular elements and a gusset opposing said truncated shoulder formed in said L-shaped member in planar alignment with each adjacent set of horizontally-oriented flanges.

3. In the improvement of claim 2, each of said legs comprising a cylinder capped at its one end, a plunger having a bell-shaped end portion disposed within said cylinder, a floor mounted to said bell-shaped end portion, a deep-stroke coil spring in its corresponding one of said deep-stroke spring-loaded assemblies disposed between said floor and capped end of said cylinder, and a lubricated bearing seated about said plunger within said cylinder below said bell-shaped end portion.

4. In the improvement of claim 3, said cylinder being formed of metal, each of said legs including a lubricated plastic sleeve seated on said bearing and separating said deep-stroke coil spring from said metal cylinder.

5. In the improvement of claim 4, said flanges and L-shaped member being made of cold-rolled steel.

6. In the device of claim 1, each of said leg assemblies being securely mounted to said frame at a corresponding corner of said device.

7. In the device of claim 2, each of said leg assemblies being securely mounted to said frame at a corresponding corner of said device.

8. In the device of claim 3, each of said leg assemblies being securely mounted to said frame at a corresponding corner of said device.

9. In the device of claim 4, each of said leg assemblies being securely mounted to said frame at a corresponding corner of said device.

10. In the device of claim 5, each of said leg assemblies being securely mounted to said frame at a corresponding corner of said device.

* * * * *